US008313175B2

(12) United States Patent
Miyata et al.

(10) Patent No.: US 8,313,175 B2
(45) Date of Patent: Nov. 20, 2012

(54) LIQUID EJECTING HEAD

(75) Inventors: Yoshinao Miyata, Matsukawa-mura (JP); Yue Gao, Matsumoto (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 13/025,330

(22) Filed: Feb. 11, 2011

(65) Prior Publication Data

US 2011/0205312 A1 Aug. 25, 2011

(30) Foreign Application Priority Data

Feb. 19, 2010 (JP) ..... 2010-034705

(51) Int. Cl.
*B41J 2/045* (2006.01)

(52) U.S. Cl. ..... 347/70

(58) Field of Classification Search ..... 347/68, 347/70–72

See application file for complete search history.

(56) References Cited

U.S. PATENT DOCUMENTS 6,886,923 B2 5/2005 Miyata

FOREIGN PATENT DOCUMENTS

| | | | | |
|---|---|---|---|---|
| JP | 10315460 | A | * | 12/1998 |
| JP | 11129469 | A | * | 5/1999 |
| JP | 2001096741 | A | * | 4/2001 |
| JP | 2001309672 | A | * | 11/2001 |
| JP | 2002096468 | A | * | 4/2002 |
| JP | 2004-034293 | | | 2/2004 |
| JP | 2009-126167 | | | 6/2009 |

* cited by examiner

*Primary Examiner* — Matthew Luu
*Assistant Examiner* — Lisa M Solomon
(74) *Attorney, Agent, or Firm* — Workman Nydegger

(57) ABSTRACT

A liquid ejecting head that can be of reduced size while maintaining reliability of the terminal connection is provided. According to the liquid ejecting head of the invention, individual element electrode terminals and first side individual electrode wiring terminals of a flexible cable, which are connected to the individual element electrode terminals are arrayed in a direction of a row of pressure chambers, and at least one of a side individual element electrode terminals located in a side portion in a terminal row direction X and a first side individual electrode wiring terminals connected to the side individual element electrode terminals are arranged inclined with respect to a center individual element electrode terminals located in the center portion in the terminal row direction.

4 Claims, 6 Drawing Sheets

LIQUID EJECTING HEAD

The entire disclosure of Japanese Patent Application No: 2010-034705, filed Feb. 19, 2010 are expressly incorporated by reference herein.

BACKGROUND

1. Technical Field

The present invention relates to liquid ejecting heads such as ink jet recording heads that eject liquid droplets from nozzles by means of pressure variation.

2. Related Art

The liquid ejecting heads that eject liquid droplets from nozzles by varying a pressure of the liquid in a pressure chamber include, for example, ink jet recording heads (hereinafter simply referred to as recording heads) used for image recording apparatuses such as ink jet recording apparatuses (hereinafter simply referred to as printers), color material ejecting heads used for manufacturing color filters for liquid crystal displays and the like, electrode material ejecting heads used for forming electrodes for field emission displays (FEDs), organic electroluminescence (EL) displays and the like, and bioorganic ejecting heads used for manufacturing biochips.

One type of liquid ejecting head is configured to eject liquid droplets by deforming piezoelectric elements (a type of pressure generating element) which are bonded to a vibration plate. In this type of liquid ejecting head, a drive voltage (drive pulse) is applied to the piezoelectric elements so as to vary the volumes of pressure chambers, thereby varying the pressure of a liquid stored in the pressure chambers, allowing the droplets of liquid to be ejected through the nozzles.

Such piezoelectric elements are, for example, as disclosed in JP-A-2004-034293, electrically connected to a film type wiring member (hereinafter referred to as a flexible cable) such as COF (Chip On Film) and TCP (Tape Career Package) having a base film made of polyimide or the like, on which ICs for activating the piezoelectric elements are mounted, and configured such that a drive voltage is applied to the piezoelectric elements through the flexible cable. The piezoelectric element includes a lower electrode film, a piezoelectric layer and an upper electrode film. In general, one of the electrodes (e.g., lower electrode film) is formed as a common element electrode that is commonly used for a plurality of piezoelectric elements, and the other electrodes (e.g., upper electrode film) are formed as individual element electrodes that are individually patterned for the respective piezoelectric elements. The piezoelectric layer is interposed between the common element electrode and the individual element electrode and acts as a piezoelectric active unit that bends in response to a drive voltage applied across both electrodes.

In recent years, recording heads are preferred in which nozzles are closely arranged and lead wires led out from the pressure generating elements are extremely closely arranged next to each other and, accordingly, the lead wire width tends to be small. This may cause a problem, such as a connection failure due to short circuit between adjacent wires. Also, a flexible cable made of polyimide or the like may expand due to heat or moisture during bonding of wires to the piezoelectric elements. Specifically, the flexible cable expands in the terminal row direction, which is the longitudinal direction of the row of terminals. As a result, it may be displaced from a predetermined connection position between the flexible cable terminals and the pressure generating element terminals, thereby causing a connection failure.

Further, a crack checking pattern for detecting a crack in a vibration plate is disposed on the vibration plate. The crack checking pattern is formed electrically independently from the common element electrode and the individual element electrode, and disposed on the vibration plate, which overlies the flow channel forming substrate having liquid passages such as pressure chambers, at the outer side relative to the terminal row of the pressure generating element. However, the widths of the crack checking pattern and the lead wires led out from the crack checking pattern both tend to be small, which makes it difficult to ensure the reliability in connection with the terminals of the flexible cable.

SUMMARY

An advantage of an aspect of the invention is that it provides a liquid ejecting head that can be of reduced size while maintaining reliability of the terminal connection.

According to an aspect of the invention, there is provided a liquid ejecting head including a flow channel forming substrate having pressure chambers which communicate with nozzles, a pressure generating element disposed on the flow channel forming substrate with a vibration plate interposed therebetween so as to vary a pressure of a liquid in the pressure chambers, at least one individual electrode terminal electrically connected to an individual electrode that constitutes a part of the pressure generating element, at least one common electrode terminal electrically connected to a common electrode that constitutes a part of the pressure generating element, and a wiring element formed of a flexible insulation member on which a wiring is provided and having wiring terminals connected to the at least one individual electrode terminal and the at least one common electrode terminal, wherein a plurality of the individual electrode terminals and a plurality of the individual wiring terminals of the wiring element which are connected to the individual electrode terminals are arrayed in a direction of a row of the pressure chambers, and wherein at least one of the individual electrode terminals located in a side portion in a terminal row direction and the individual wiring terminals connected to the individual electrode terminals are arranged inclined with respect to the individual electrode terminals located in the center portion in the terminal row direction.

Accordingly, the individual electrode terminals and the individual wiring terminals of the wiring element which are connected to the individual electrode terminals are arrayed in a direction of a row of the pressure chambers, and at least one of the individual electrode terminals located in the side portion in the terminal row direction and the individual wiring terminals connected to the individual electrode terminals are arranged inclined with respect to the individual electrode terminals located in the center portion in the terminal row direction, toward the terminal row direction, therefore, even if the wiring member expands in the terminal row direction due to heat or moisture during the connection of the individual wiring terminals of the wiring member to the individual electrode terminals of the pressure generating element, causing the distances between the individual wiring terminals to be increased, the alignment of connection positions of the terminals may be achieved by moving the wiring member and the pressure generating element relative to each other in a direction transversely of the terminal row direction. This makes it possible to connect the individual electrode terminals and the individual wiring terminals while keeping their alignment, thereby allowing for a liquid ejecting head that can be of reduced size while maintaining reliability of the terminal connection.

Preferably, according to the above aspect of the invention, the common electrode terminals are arranged on the line of the terminal row direction, and at least one of the common electrode terminals and the common wiring terminals connected to the common electrode terminals are arranged inclined with respect to the individual electrode terminals located in the center portion in the terminal row direction, toward the terminal row direction.

Accordingly, the common electrode terminals are arranged on the line of the terminal row direction, and at least one of the common electrode terminals and the common wiring terminals connected to the common electrode terminals are arranged inclined with respect to the individual electrode terminals located in the center portion in the terminal row direction, toward the terminal row direction, therefore, even if the wiring member expands in the terminal row direction due to heat or moisture during the connection of the common wiring terminals of the wiring member to the common electrode terminals of the pressure generating element, the alignment of connection positions of the terminals may be achieved by moving the wiring member and the pressure generating element relative to each other in a direction transversely of the terminal row direction. This makes it possible to connect the common electrode terminals and the common wiring terminals while keeping their alignment.

Preferably, according to the above aspect of the invention, the liquid ejecting head further includes a metal layer formed on the vibration plate and electrically independent from the individual electrode and the common electrode, wherein the metal layer is provided with metal layer electrode terminals, which are connected to the metal layer wiring terminals of the wiring member, on the outer side relative to the individual electrode terminals located in the side portion in the terminal row direction, and wherein at least one of the metal layer electrode terminals and the metal layer wiring terminals are arranged inclined with respect to the individual electrode terminals located in the center portion in the terminal row direction, toward the terminal row direction.

Accordingly, the liquid ejecting head further includes the metal layer formed on the vibration plate and electrically independent from the individual electrode and the common electrode, wherein the metal layer is provided with metal layer electrode terminals, which are connected to the metal layer wiring terminals of the wiring member, on the outer side relative to the individual electrode terminals located in the side portion in the terminal row direction, and wherein at least one of the metal layer electrode terminals and the metal layer wiring terminals are arranged inclined with respect to the individual electrode terminals located in the center portion in the terminal row direction, toward the terminal row direction, therefore, by conducting a continuity test between the common element electrodes, the metal layer and the ink in the pressure chambers, it is possible to identify the location of the connection failure and its causes, specifically, whether it is caused by a crack generated on the vibration plate or poor connection between terminals.

Preferably, according to above aspect of the invention, the inclination angle of the terminal is configured to increase as the terminal becomes more distant from the individual electrode terminals located in the center portion in the terminal row direction.

Accordingly, the inclination angle of the terminal is configured to increase as the terminal becomes more distant from the individual electrode terminals located in the center portion in the terminal row direction, therefore it is possible to connect the electrode terminals and the wiring terminals while maintaining the alignment of their connection positions with high reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the present invention will be described below with reference to the accompanying drawings. Although the embodiments described herein include various limitations as preferred examples, those embodiments are not intended to limit the scope of the invention unless a description that specifically limits the invention is provided. The invention is explained by using an ink jet recording head (hereinafter simply referred to as a recording head) which is mounted in an ink jet printer (a type of liquid ejecting apparatus of the invention) as an example of a liquid ejecting head of the invention.

Figure 1:
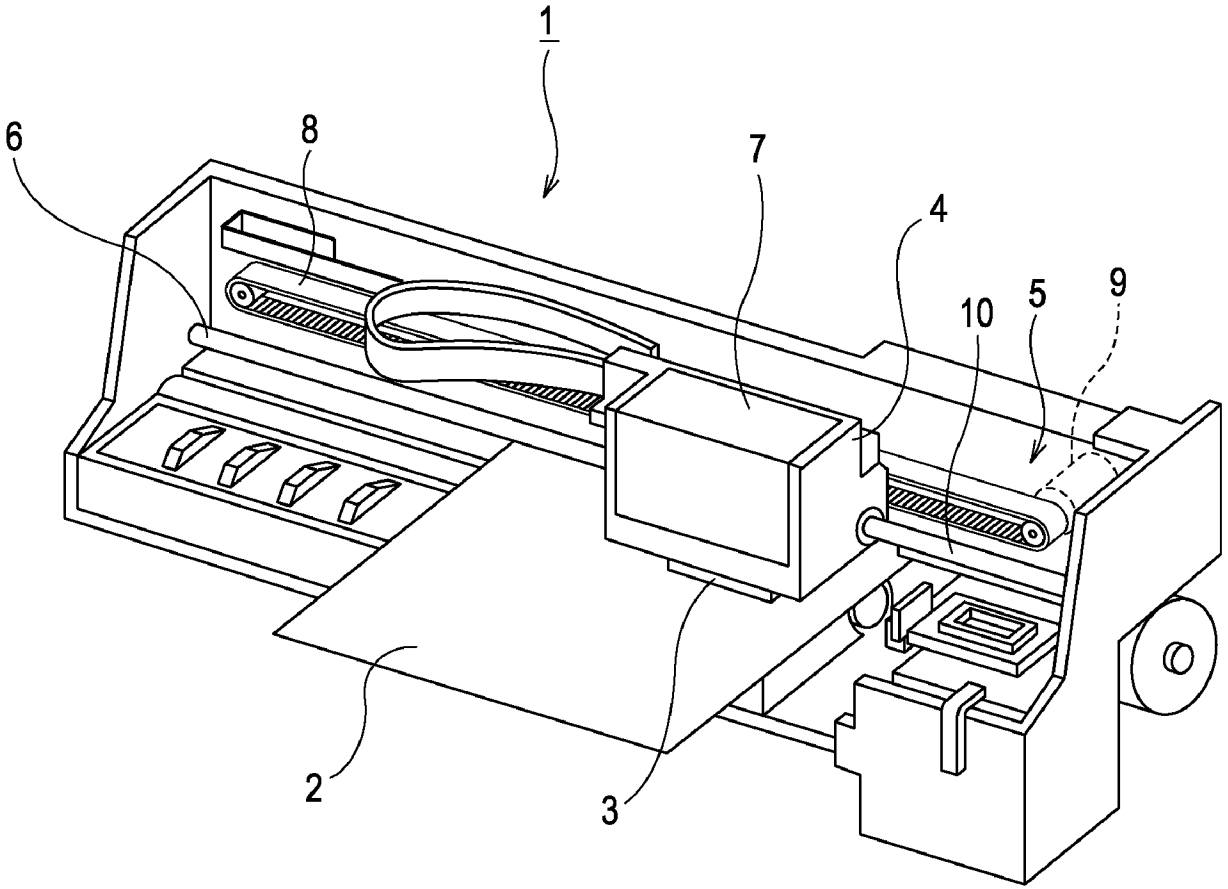
FIG. 1 is a perspective view explaining a configuration of a printer.

First, a general configuration of a printer according to a first embodiment is explained with reference to FIG. 1. A printer 1 is an apparatus that performs recording of images and the like by ejecting ink in a liquid form to a surface of a recording medium 2 such as a recording sheet. The printer 1 includes a recording head 3 that ejects ink, a carriage 4 on which the recording head 3 is mounted, a carriage movement mechanism 5 that moves the carriage 4 in a primary scanning direction, a platen roller 6 that moves the recording medium 2 in a secondary scanning direction. Here, the above-mentioned ink is a type of liquid of the invention, which is stored in an ink cartridge 7. The ink cartridge 7 is removably attached to the recording head 3. A configuration may also be employed in which the ink cartridge 7 is disposed on the body of the printer 1 such that ink is supplied from the ink cartridge 7 to the recording head 3 via an ink supply tube.

The carriage movement mechanism 5 includes a timing belt 8, which in turn is driven by a pulse motor 9 such as a DC motor. Accordingly, upon the actuation of the pulse motor 9, the carriage 4 is guided by a guide rod 10 which is mounted on the printer 1 to be moved in the primary scanning direction (a widthwise direction of the recording medium 2) in a reciprocating manner.

Figure 2:
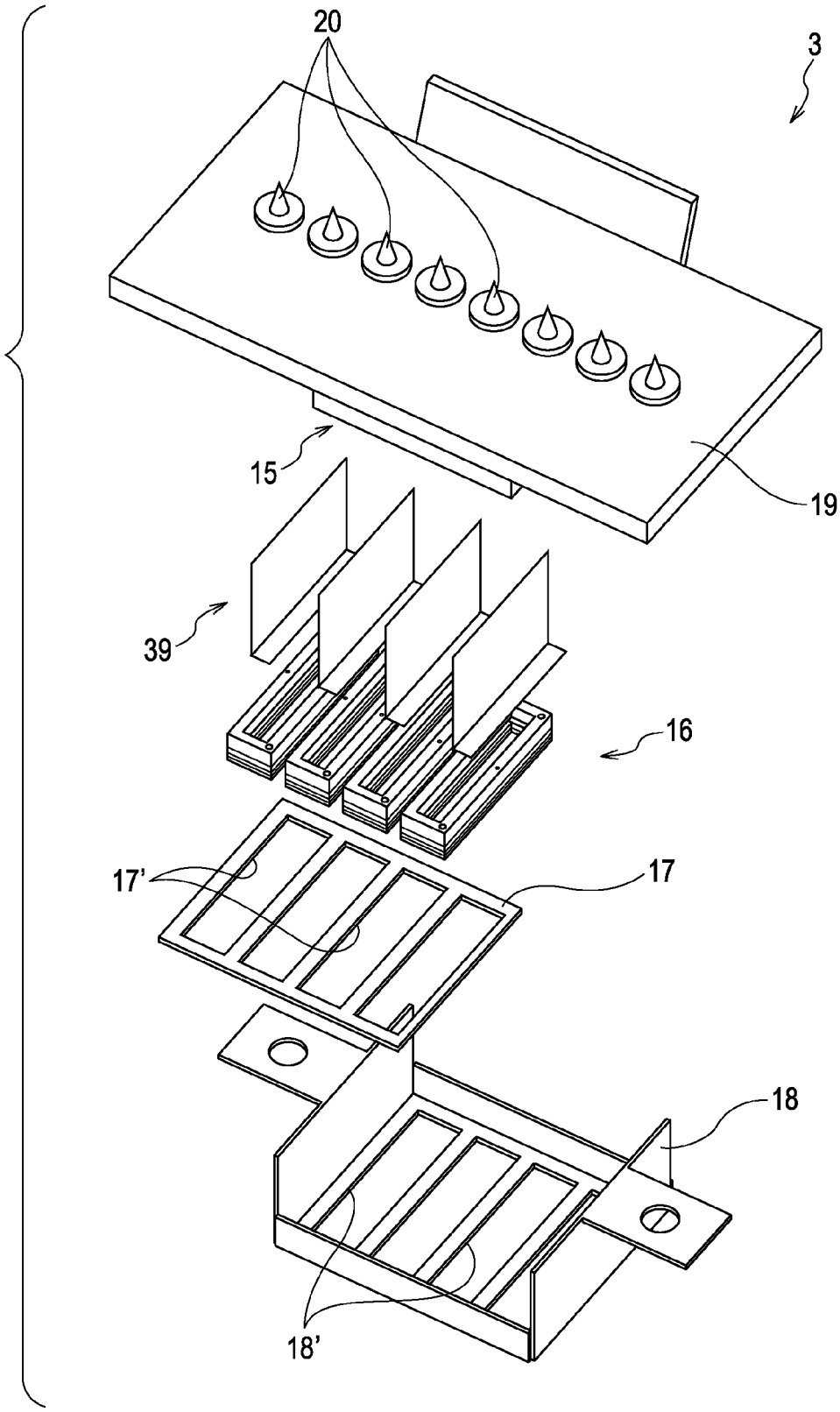
FIG. 2 is an exploded perspective view of a recording head as seen from obliquely above.

FIG. 2 is an exploded perspective view showing a configuration of the recording head 3. According to this embodiment, the recording head 3 is generally composed of a case 15, a plurality of head units 16, a unit fixation plate 17 and a head cover 18.

The case 15 is a box-shaped member that houses the head unit 16, a converging channel (not shown) and other components therein, and has a needle holder 19 on the top thereof. The needle holder 19 is a plate-shaped member for mounting ink introduction needles 20 thereon. In this embodiment, eight ink introduction needles 20 corresponding to the ink colors of the ink cartridge 7 are disposed side by side on the needle holder 19. Each ink introduction needle 20 is a hollow needle which is adapted to be inserted into the ink cartridge 7 so as to allow ink stored in the ink cartridge 7 to flow out through the introduction hole (not shown) formed at the tip of the ink introduction needle 20 and be introduced into the head unit 16 via the converging channel in the case 15.

At the bottom of the case 15, four head units 16 are arranged side by side in the primary scanning direction. The head units 16 are bonded to a unit fixation plate 17 which is made of a metal and has four openings 17', each corresponding to the head units 16, and further secured by a head cover 18 which is also made of a metal and has four openings 18' each corresponding to the head units 16.

Figure 3:
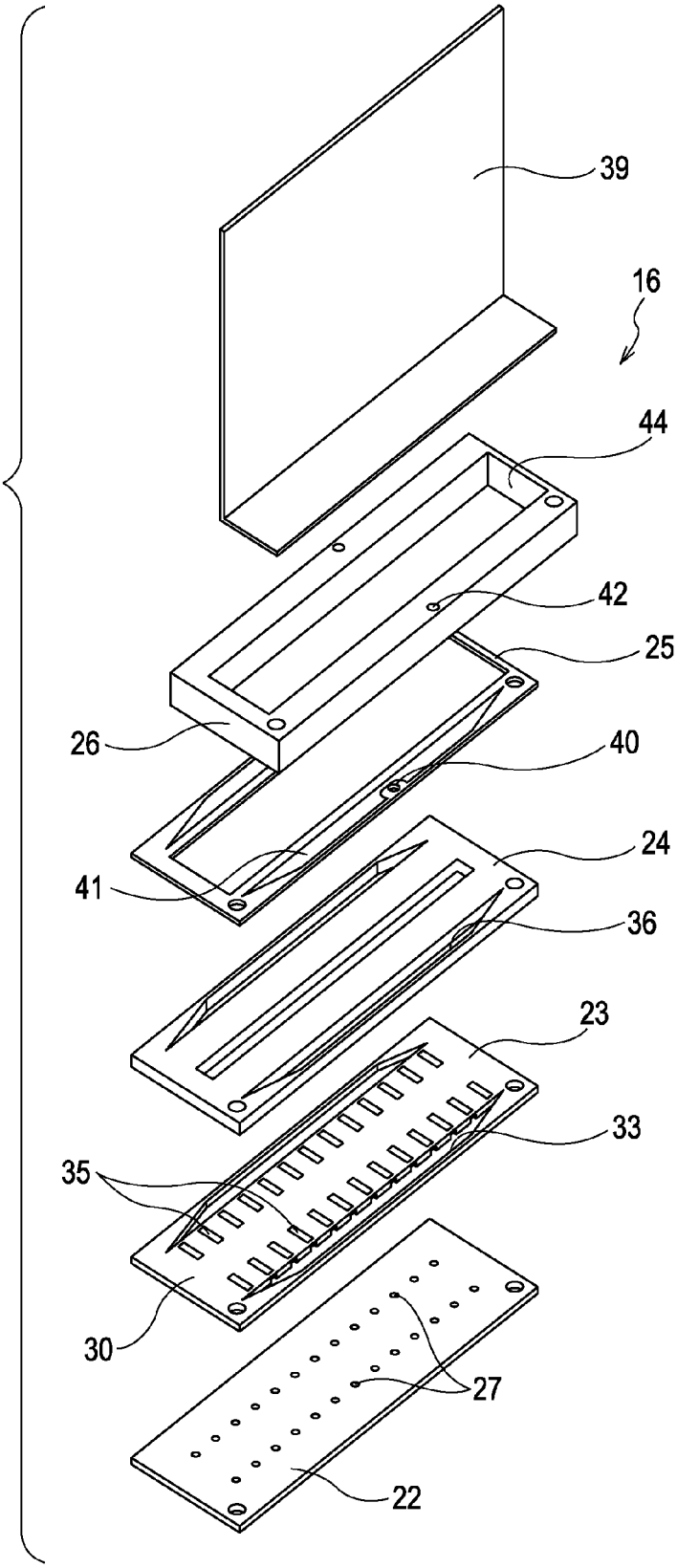
FIG. 3 is an exploded perspective view of a head unit.
Figure 4:
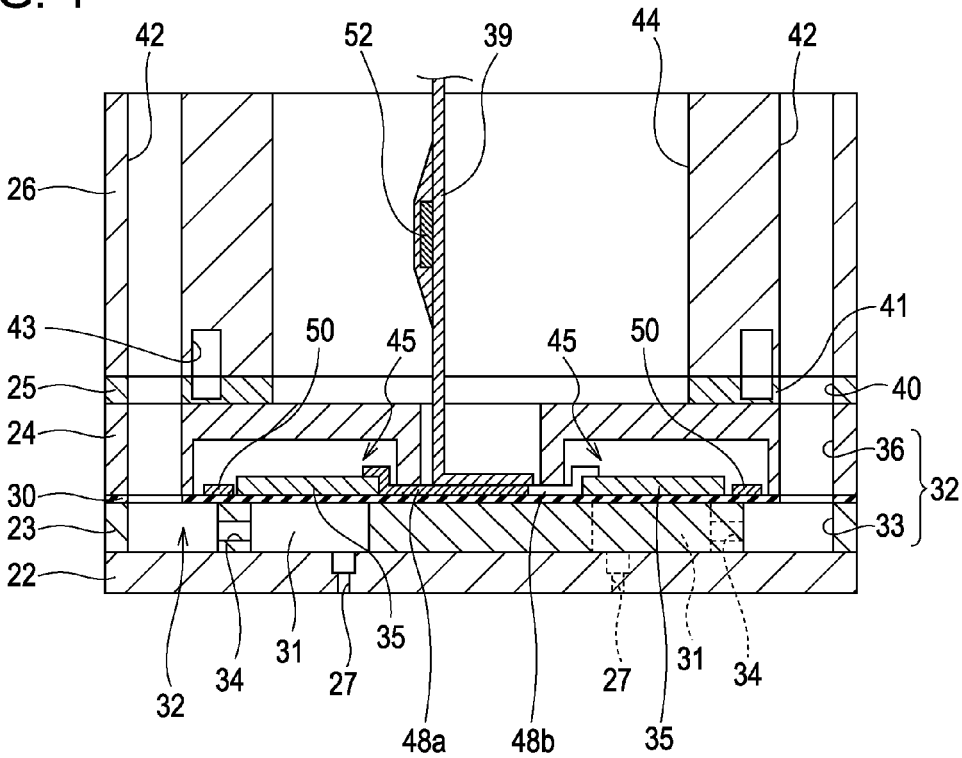
FIG. 4 is a sectional view of an essential portion of the head unit.

FIG. 3 is an exploded perspective view showing a configuration of the head unit 16 (a liquid ejecting head defined in a narrower sense than the recording head 3), and FIG. 4 is a sectional view of the head unit 16. For convenience of explanation, the direction that the respective members are stacked is taken as the vertical direction.

In this embodiment, the head unit 16 is generally composed of a nozzle plate 22, a flow channel substrate 23 (which corresponds to the flow channel forming substrate of the invention), a common liquid chamber substrate 24 and a compliance substrate 25, with each member being stacked and mounted in a unit case 26.

The nozzle plate 22 (a type of nozzle forming member) is a plate-shaped member having a plurality of nozzles 27 in rows at a pitch corresponding to the dot forming density. In this embodiment, nozzle rows are composed of 180 nozzles 27 arranged at a pitch of 180 dpi.

The flow channel substrate 23 has an extremely thin elastic film 30 of silicon dioxide (which corresponds to the vibration plate of the invention) formed on the upper surface (the side facing a common liquid chamber substrate 24) by a thermal oxidization process. In the flow channel substrate 23, pressure chambers 31 which are separated by a plurality of partitions by an anisotropic etching process are arrayed in a plurality of rows, with the pressure chambers 31 corresponding to the nozzles 27, as shown in FIG. 4. In the flow channel substrate 23, communication holes 33 are formed on the outer side relative to the pressure chambers 31. Each communication hole 33 constitutes a part of the common liquid chamber 32 where ink commonly used for the pressure chambers 31 is introduced. The communication hole 33 communicates with the pressure chamber 31 via an ink supply passage 34.

The elastic film 30, which is disposed on the flow channel substrate 23, is provided with piezoelectric elements 35 (which correspond to the pressure generating element of the invention) on the top surface thereof. Each of the piezoelectric elements 35 is associated with one of the pressure chambers 31, and formed of a metallic lower electrode film (common element electrode 46), piezoelectric layer (not shown) made of lead zirconate titanate (PZT) and the like, and a metallic upper electrode film (individual element electrode 47), which are layered in sequence. The illustrated piezoelectric element 35 is a so-called flexural mode piezoelectric element and configured to cover the upper side of the pressure chamber 31. The element electrodes 47 and 46 of the piezoelectric element 35 have electrode terminals 48 and 49, respectively, each extending onto the elastic film 30. The electrode terminals 48 and 49 are electrically connected to wiring terminals 53 and 55 of the flexible cable 39. Each piezoelectric element 35 is configured to be deformed when a drive voltage is applied across the individual element electrode 47 and the common element electrode 46 through the flexible cable 39. In this embodiment, the elastic film 30, the piezoelectric element 35 having the electrodes 46 and 47, and the electrode terminals 48 and 49 which are electrically connected to each electrode of the piezoelectric element 35, collectively correspond to an actuator unit 45 of the invention. The details of the electrode terminals and the flexible cable 39 will be described later.

The common liquid chamber substrate 24 (protective substrate) having through holes 36 which extend in the thickness direction thereof is disposed above the flow channel substrate 23 which contains the piezoelectric elements 35. Similar to the flow channel substrate 23 and the nozzle plate 22, the common liquid chamber substrate 24 is also formed of a monocrystalline silicon substrate. The through hole 36 in the common liquid chamber substrate 24 is configured to communicate with the communication hole 33 of the flow channel substrate 23 and collectively constitute a part of the common liquid chamber 32.

Further, the compliance substrate 25 is disposed on the upper surface of the common liquid chamber substrate 24. The compliance substrate 25 is provided with ink introduction ports 40 formed so as to extend through the compliance substrate 25 at positions opposite the through holes 36 of the common liquid chamber substrate 24. The ink introduction port 40 allows ink to be supplied from the ink introduction needle 20 into the common liquid chamber 32. Further, flexile portions 41 each provided with a cavity having extremely thin walls are formed in the compliance substrate 25 at positions opposite the ink introduction ports 40. The flexile portion 41 acts as a compliance portion that absorbs the variation in pressure of the ink stored in the common liquid chamber 32 which communicates with the ink introduction port 40.

The unit case 26 is provided with ink introduction passages 42 that communicate with the ink introduction ports 40 so as to supply ink which is introduced from the ink introduction needles 20 into the common liquid chambers 32. The unit case 26 further includes recesses 43 formed at positions opposite the flexile portions 41 so as to permit the expansion of the flexile portions 41. In the unit case 26, a cavity 44 is formed to extend through the center of the unit case 26 in the thickness direction and configured such that one end of the flexible cable 39 is inserted therein and connected with the element electrode terminals of the actuator unit 45.

Then, the nozzle plate 22, the flow channel substrate 23, the common liquid chamber substrate 24, the compliance substrate 25 and the unit case 26 are stacked in sequence with an adhesive or thermal adhesive film interposed therebetween, and heated so as to be bonded together.

The head unit 16, configured in the above-mentioned manner, is housed in the recording head 3. The recording head 3 is mounted on the carriage 4 with each nozzle plate 22 facing the platen 5 such that the direction of the nozzle rows is consistent with the secondary scanning direction. In each head unit 16, ink flows from the ink cartridge 7 via the ink introduction passages 42 into the ink introduction ports 40, and then into the common liquid chambers 32. Then, the ink passage (a type of liquid passage) between the common liquid chamber 32 and the nozzle 27 is filled with ink. A drive voltage is supplied through the flexible cable 39 to the piezoelectric elements 35 so as to deform the piezoelectric elements 35, thereby varying the pressure of ink in the corresponding pressure chambers 31, allowing the ink to be ejected through the nozzles 27.

Figure 5:
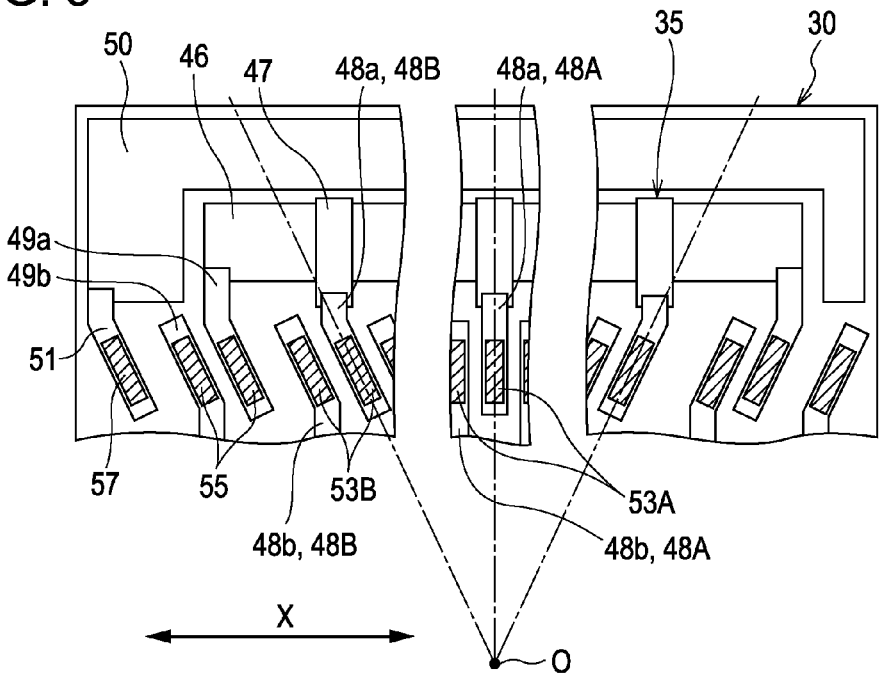
FIG. 5 is a schematic view illustrating a layout of element electrodes and electrode terminals of piezoelectric elements.

FIG. 5 is a schematic view illustrating a layout of the element electrodes of the piezoelectric elements 35 and the element electrode terminals (lead electrodes) which extend from the element electrodes. In FIG. 5, the shaded portions indicate wiring terminals of the flexible cable 39 which are connected to the respective electrode terminals 48. Further, the direction the nozzles are arrayed (the direction the piezoelectric elements are arrayed) is shown as a lateral direction in FIG. 5. Two nozzle rows are configured to have the same configuration, one of them is substantially shown in the figure, while the other is omitted from the illustration except for its electrode terminals. In this embodiment, the electrode film uses platinum or gold as its material.

According to this embodiment, the elastic film 30 that defines a part of the pressure chambers 31 is provided with the common element electrode 46 that is connected with the piezoelectric elements 35 in common is continuously formed in a rectangular shape in plan view, elongated in the nozzle row direction. On the common element electrode 46, the piezoelectric layer (not shown) and the individual element electrode 47 are stacked in sequence and the patterning is made for each piezoelectric element 35. The longitudinal dimension (the direction perpendicular to the nozzle row) of the individual element electrode 47 is slightly longer than the shorter width of the common element electrode 46, while the width dimension (shorter dimension) of the individual element electrode 47 is approximately the same size as the width of the pressure generating element 35.

Further, the individual element electrode terminals 48 (a type of individual electrode terminal) each having a strip shape in plan view and electrically connected to the corresponding individual element electrodes 47 are disposed in a plurality of rows lying in the direction of the row of the pressure chambers 31 (the nozzle row direction) between the adjacent nozzle rows. More specifically, the individual element electrode terminals 48 include center individual element electrode terminals 48A which are located in the center portion in the terminal row direction (the same direction as the nozzle row direction, indicated by an arrow X in FIG. 5) and side individual element electrode terminals 48B which are located in the side portion in the terminal row direction X. The center individual element electrode terminals 48A extend in the direction perpendicular to the terminal row direction X. On the other hand, the side individual element electrode terminals 48B are bent, with the proximal end portions thereof that are connected to the element electrodes 47 extending in the direction perpendicular to the terminal row direction X, and the distal end portions extending toward the center individual element electrode terminals 48A, obliquely with respect to the terminal row direction X. More specifically, the side individual element electrode terminals 48B associated with one of the two nozzle rows are inclined inwardly toward the center individual element electrode terminals 48A (if no terminal is disposed at the center portion in the terminal row direction, the center position in the terminal row direction; the same applies hereinafter), while the adjacent side individual element electrode terminals 48*b* (48B) associated with the other of the two nozzle rows are inclined outwardly away from the center individual element electrode terminals 48A. In addition, the inclination direction of the side individual element electrode terminals 48B may be opposite to that in the illustrated configuration. That is, the side individual element electrode terminals 48B associated with one of the two nozzle rows may be inclined outwardly away from the center individual element electrode terminals 48A, and the side individual element electrode terminals 48B associated with the other of the two nozzle rows may be inclined inwardly toward the center individual element electrode terminals 48A. In this case, the inclination directions of the common element electrode terminals 49, which will be described below in detail, metal layer electrode terminals 51 and wiring terminals of the flexible cable 39 are opposite to those of the illustrated embodiment. In addition, the side individual element electrode terminals 48B are defined as the individual element electrode terminals 48 which are located at the outer side relative to a group of the center individual element electrode terminals in the terminal row direction, wherein the group of the center individual element electrode terminals are defined as a specified number of the side individual element electrode terminals 48 from the center individual element electrode terminals 48A in the terminal row direction. Alternatively, as will be described in the second embodiment, the side individual element electrode terminals 48B may be defined as the individual element electrode terminals 48 other than the center individual element electrode terminals 48A (if no electrode terminal is disposed at the center portion in the terminal row direction, the individual element electrode terminals 48 which are located on the outer side relative to the center position in the terminal row direction).

That is, the element electrode terminals 48 of each nozzle row, as viewed in general, are arranged radially from the center point (reference point) of the virtual origin (indicated by reference symbol O in FIG. 5) which is set closer to the other nozzle row. The longitudinal dimension of the individual element electrode terminal 48 is defined so as not to reach an adjacent common element electrode 46. Further, the width dimension (shorter dimension) of the individual element electrode terminal 48 is approximately the same size as the width of the individual element electrode 47. The respective individual element electrode terminals 48*a* associated with one of the nozzle rows (the upper row in the figure) and the respective individual element electrode terminals 48*b* associated with the other of the nozzle rows (the lower row which is omitted from the illustration) are arranged alternately at a constant pitch in the nozzle row direction. The individual element electrode terminals 48 are electrically connected to individual electrode wiring terminals 53 (see FIG. 6) at one side of the flexible cable 39.

Moreover, the common element electrode terminals 49 (a type of common electrode terminal) each having a strip shape in plan view are disposed at both sides of the common element electrode 46 associated with the nozzle row, on the line of the terminal row direction X. More specifically, the common element electrode terminals 49 are bent, with the proximal end portions thereof extending in the direction perpendicular to the terminal row direction X, and the distal end portions extending toward the center individual element electrode terminals 48A, obliquely with respect to the terminal row direction X. More specifically, the common element electrode terminals 49*a* associated with one of the two nozzle rows are inclined inwardly toward the center individual element electrode terminals 48A, while the common element electrode terminals 49*b* associated with the other of the two nozzle rows are inclined outwardly away from the center individual element electrode terminals 48A.

Further, common element electrode terminals 49*a* associated with one of the nozzle rows (the upper row in the figure) and common element electrode terminals 49*b* associated with the other of the nozzle rows (the lower row which is omitted from the illustration) are paired and spaced apart from each other. They are positioned on the outer side relative to the side individual element electrode terminals 48B in the terminal row direction X. The common element electrode terminals 49 are electrically connected to common electrode wiring terminals 55 (see FIG. 6) at one side of the flexible cable 39.

Further, in this embodiment, a metal layer 50 is formed on the elastic film 30 and is electrically independent from the individual element electrodes 47 containing the individual element electrode terminals 48 and the common element electrodes 46 containing the common element electrode terminals 49. The metal layer 50 is disposed apart from the common element electrode 46 at a certain distance so as to cover the portion of the elastic film 30 which is the outer side relative to the common element electrodes 46. The metal layer electrode terminals 51 each having a strip shape in plan view are disposed at one side of the metal layer 50 associated with the nozzle row in the nozzle row direction (left-hand side in the figure), on the outer side relative to the individual element electrode terminals in the terminal row direction X. More specifically, the metal layer electrode terminals 51 are bent, with the proximal end portions thereof extending in the direction perpendicular to the terminal row direction X, and the distal end portions extending toward the center individual element electrode terminals 48A, obliquely with respect to the terminal row direction X. That is, the metal layer electrode terminals 51 are arranged with the portion opposite to the metal layer 50 extending obliquely toward the center individual element electrode terminals 48A. The metal layer electrode terminals 51 are electrically connected to the metal layer wiring terminals 57 (see FIG. 6) at one side of the flexible cables 39.

Figure 6:
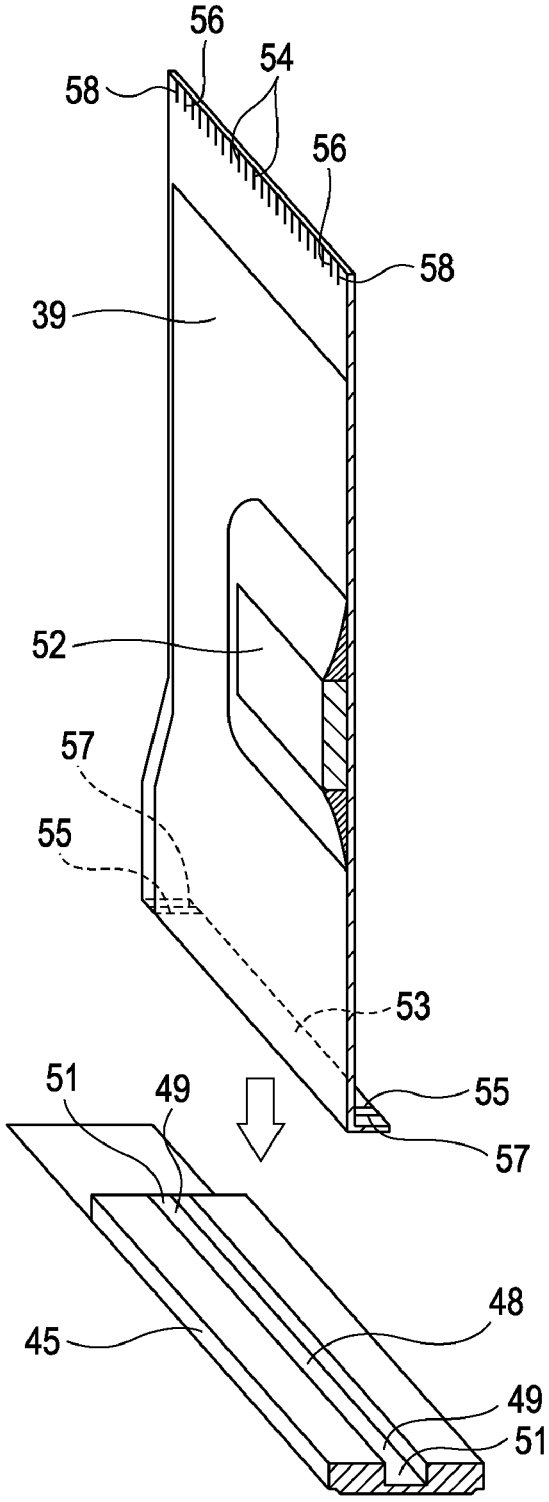
FIG. 6 is a perspective view explaining a configuration of a flexible cable and an actuator unit.

FIG. 6 is a perspective view explaining a configuration of the flexible cable (which corresponds to wiring member of the invention) and the actuator unit 45.

The flexible cables 39 has one side (surface) of the base film in a rectangular shape made of polyimide or the like, which is provided with a control IC 52 for controlling the application of the drive voltage to the piezoelectric elements 35, as well as patterns of individual electrode wiring, common electrode wiring and metal layer wiring (none of them shown), which are connected to the control IC 52. Moreover, on a first side (lower end as viewed in the FIG. 6) of the flexible cables 39, first side individual electrode wiring terminals 53 (a type of individual electrode wiring terminal of the invention), which correspond to the individual element electrode terminals 48 (48*a*, 48*b*) of the actuator unit 45 are provided in a plurality of rows. Further, on the first side of the flexible cables 39, first side common electrode wiring terminals 55 (a type of common electrode wiring terminal of the invention), which correspond to the common element electrode terminals 49 (49*a*, 49*b*) of the actuator unit 45 are provided in a plurality of rows on the outer side relative to the first side individual electrode wiring terminals 53 in the row direction at positions other than the individual element electrode terminals 48. Further, on the first side of the flexible cables 39, first side metal layer wiring terminals 57 (a type of metal layer wiring terminal of the invention), which correspond to the metal layer electrode terminals 51 of the actuator unit 45 are provided on the outer side relative to the first side common electrode wiring terminals 55 in the direction of row of the first side individual electrode wiring terminals 53.

On the surface of second side (upper end as viewed in FIG. 6) of the flexible cables 39, second side individual electrode wiring terminals 54, which are connected to substrate terminals of a substrate (not shown) that transmit signals from the printer body are provided in a plurality of rows. Further, on the second side of the flexible cables 39, second side common electrode wiring terminals 56, which are connected to the substrate terminals of the substrate are provided on both sides of the second side individual electrode wiring terminals 54 in the row direction. Further, on the second side of the flexible cables 39, second side metal layer wiring terminals 58, which are connected to the substrate terminals of the substrate are provided on the outer side relative to second side common electrode wiring terminals 56 in the direction of row of the second side individual electrode wiring terminals 54. Moreover, the area of the wiring patterns other than wiring terminals (the individual electrode wiring terminals 53 and 54, the common electrode wiring terminals 55 and 56, and the metal layer wiring terminals 57 and 58) and the control IC 52 on the flexible cables 39 is covered with the resist.

When connecting the wiring with the actuator unit 45, the first side of the flexible cable 39 is configured to be bent between a region in which the wiring terminals are formed and a region in which the wiring patterns are formed to the side opposite to the surface on which the wiring patterns are formed at approximately a right angle (see FIGS. 3, 4 and 6). With this configuration, when the flexible cable 39 is connected to the actuator unit 45, the region in which the wiring terminals 53, 55 and 57 are formed opposes the electrode terminals 48, 49 and 51 on the actuator unit 45. During the connection in this embodiment, as shown in FIG. 5, the first side individual electrode wiring terminals 53A of the first side individual electrode wiring terminals 53 which are connected to the center individual element electrode terminals 48A extend in the direction perpendicular to the terminal row direction X. On the other hand, the first side individual electrode wiring terminals 53B which are connected to the side individual element electrode terminals 48B, are inclined with respect to the center individual element electrode terminals 48A. Further, the first side common electrode wiring terminals 55 which are connected to the common element electrode terminals 49, and the first side metal layer wiring terminals 57 which are connected to the metal layer electrode terminals 51 are inclined with respect to the center individual element electrode terminals 48A. The inclination directions of the wiring terminals 53B, 55 and 57 are aligned with those of the corresponding terminals of the actuator unit.

The wiring terminals 53, 55 and 57 are plated with solder in advance. The wiring terminals 53, 55 and 57 are each soldered, and thus electrically connected, to the corresponding electrode terminals 48, 49 and 51 of the actuator unit 45, thereby the flexible cable 39 is connected to the actuator unit 45. That is, the first side individual electrode wiring terminals 53 of the flexible cable 39 are connected to the corresponding individual element electrode terminals 48 of the actuator unit 45, while the first side common electrode wiring terminals 55 of the flexible cable 39 are connected to the corresponding common element electrode terminals 49*a* and 49*b* of the actuator unit 45. Further, the wiring terminals 54, 56 and 58 are electrically connected to the corresponding substrate terminals of the above-mentioned substrate by means of soldering.

The following explains the case where the flexible cables 39 expands during the connection with the piezoelectric elements 35.

Figure 7:
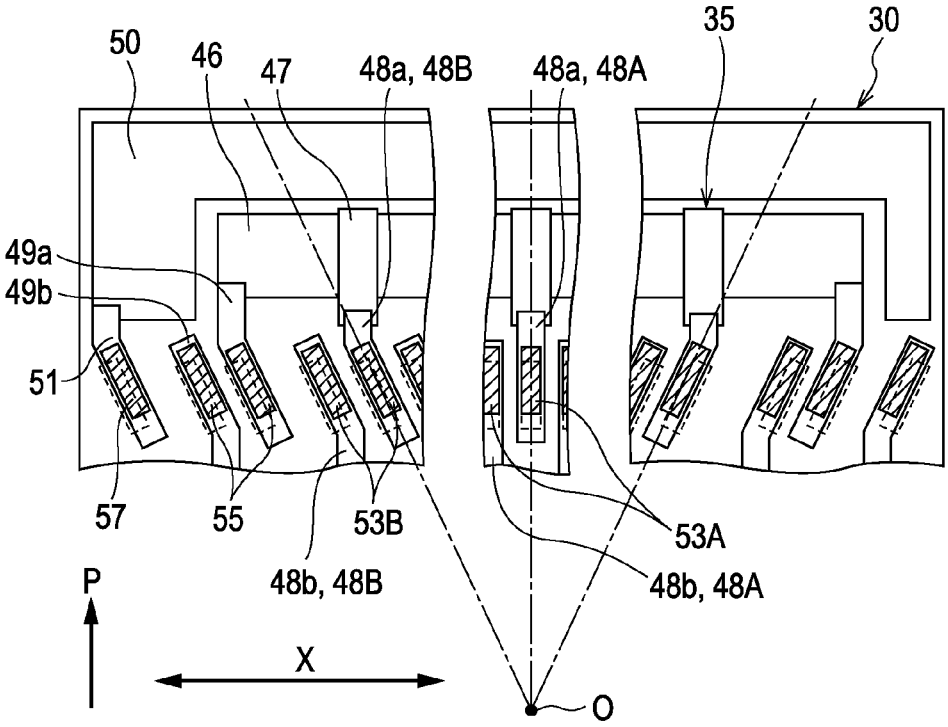
FIG. 7 is a schematic view illustrating an alignment of the flexible cable and the actuator unit when they are connected.

FIG. 7 is a schematic view illustrating an alignment of the flexible cable 39 and the actuator unit 45 when they are connected.

As above described, the flexible cable 39 includes a base film made of polyimide or the like. When the flexible cable 39 is heated or absorbs moisture during the connection to the piezoelectric elements 35 for example by soldering, it expands longitudinally, specifically in the terminal row direction X in which the terminals are arrayed in a row, causing the distances between the wiring terminals 53, 55 and 57 formed on the base film to be increased. As a result, the connecting positions of wiring terminals 53, 55 and 57 to the electrode terminals 48, 49 and 51 are displaced in the terminal row direction X (as indicated by the dotted line in FIG. 7). Once the connecting positions are displaced, the alignment between the electrode terminals 48, 49 and 51 and the wiring terminals 53, 55 and 57 may be achieved by detecting the connecting positions of the terminals, using imaging technique or the like, allowing the flexible cables 39 to be moved (slid) relative to the piezoelectric elements 35 away from the virtual origin O in the direction perpendicular to the terminal row direction X (the movement direction is indicated by P in the figure). It will be noted that, when the flexible cables 39 is contracted due to the fall in temperature or humidity, the flexible cables 39 may be moved relative to the piezoelectric elements 35 to the direction opposite to the movement direction P.

Accordingly, the recording head 3 according to this embodiment is configured such that the side individual element electrode terminals 48B, the common element electrode terminals 49 and the metal layer electrode terminals 51 of the piezoelectric elements 35, and the first side individual electrode wiring terminals 53B, the first side common electrode wiring terminals 55 and the first side metal layer wiring terminals 57 of the flexible cable 39 are connected with each other, respectively, and arrayed in the terminal row direction X, inclined with respect to the center individual element electrode terminals 48A, toward the terminal row direction X. Therefore, even if the flexible cables 39 expands in the terminal row direction X due to a heat or moisture during the connection of the wiring terminals 53, 55 and 57 of the flexible cable 39 to the electrode terminals 48, 49 and 51 of the piezoelectric element 35, causing the distances between the wiring terminals 53, 55 and 57 to be increased, the alignment between the wiring terminals 53, 55 and 57 and the electrode terminals 48, 49 and 51 may be achieved by moving the flexible cable 39 relative to the piezoelectric element 35 away from the virtual origin O in a direction P, which is the direction perpendicular to the terminal row direction X. This allows the wiring terminals 53, 55 and 57 and the electrode terminals 48, 49 and 51 to be connected while being aligned each other and ensuring the connection areas, thereby enabling the size of recording head 3 to be reduced with high connection reliability.

Further, the metal layer 50 is provided on the elastic film 30 and electrically independent from the individual element electrodes 47 and the common element electrodes 46. The metal layer 50 is provided with the metal layer electrode terminals 51 on the outer side relative to the side individual element electrode terminals 48B, which are connected to the first side metal layer wiring terminals 57 of the flexible cable 39. One of the metal layer electrode terminals 51 and the first side metal layer wiring terminals 57 are arranged inclined with respect to the center individual element electrode terminals 48A which are located at the center portion in the terminal row direction X, toward the terminal row direction X, therefore, by conducting a continuity test between the common element electrodes 46, the metal layer 50 and the ink in the pressure chambers 31, it is possible to identify the location of the connection failure and its causes, specifically, whether it is caused by a crack generated on the elastic film 30 or poor connection between terminals.

The present invention is not limited to the above embodiment, a variety of modifications can be made based on the scope of the invention described in the attached claims.

Although the inclination angle of the terminal to the center individual element electrode terminals 48A has been described as being constant, the inclination angle of the terminal may be configured to increase as the terminal becomes more distant from the individual electrode terminals 48A located in the center portion in the terminal row direction (second embodiment). With this configuration, it is possible to connect the electrode terminals 48, 49 and 51 and the wiring terminals 53, 55 and 57 while maintaining the alignment of their connection positions with high reliability.

Although a so-called flexure type of the piezoelectric elements 35 has been exemplified, the pressure generating means is not limited to the above. For example, the invention is applicable to the case where so-called vertical vibration type of the piezoelectric elements or heat generating elements is used.

Further, the invention is applicable to any apparatus other than printers, such as plotters, facsimile machines, copy machines, a variety of ink jet recording apparatuses, and liquid ejecting apparatuses other than recording apparatuses, including display machines, electrode manufacturing machines and chip manufacturing machines.

What is claimed is:

1. A liquid ejecting head comprising:

a flow channel forming substrate having pressure chambers which communicate with nozzles, a pressure generating element disposed on the flow channel forming substrate with a vibration plate interposed therebetween so as to vary a pressure of a liquid in the pressure chambers, at least one individual electrode terminal electrically connected to an individual electrode that constitutes a part of the pressure generating element, at least one common electrode terminal electrically connected to a common electrode that constitutes a part of the pressure generating element, and a wiring element formed of a flexible insulation member on which wiring is provided and having wiring terminals connected to the at least one individual electrode terminal and the at least one common electrode terminal, wherein a plurality of the individual electrode terminals and a plurality of the individual wiring terminals of the wiring element which are connected to the individual electrode terminals are arrayed in a direction of a row of the pressure chambers, and wherein at least one of the individual electrode terminals located in a side portion in a terminal row direction and the individual wiring terminals connected to the individual electrode terminals are arranged inclined with respect to the individual electrode terminals located in the center portion in the terminal row direction.

2. The liquid ejecting head according to claim 1, wherein the common electrode terminals are arranged in the terminal row direction, and wherein at least one of the common electrode terminals and the common wiring terminals connected to the common electrode terminals are arranged inclined with respect to the individual electrode terminals located in the center portion in the terminal row direction, toward the terminal row direction.

3. The liquid ejecting head according to claim 1, further comprising:

a metal layer formed on the vibration plate and electrically independent from the individual electrode and the common electrode, wherein the metal layer is provided with metal layer electrode terminals, which are connected to the metal layer wiring terminals of the wiring member, on the outer side relative to the individual electrode terminals located in the side portion in the terminal row direction, and wherein at least one of the metal layer electrode terminals and the metal layer wiring terminals are arranged inclined with respect to the individual electrode terminals located in the center portion in the terminal row direction, toward the terminal row direction.

4. The liquid ejecting head according to claim 1, wherein the inclination angle of the terminal is configured to increase as the terminal becomes more distant from the individual electrode terminals located in the center portion in the terminal row direction.

* * * * *